US005894688A

United States Patent [19]

Struck et al.

[11] Patent Number: 5,894,688

[45] Date of Patent: Apr. 20, 1999

[54] POWER ASSISTED SNOWPLOW SUPPORT STAND

[75] Inventors: John M. Struck, Iron Ridge; Lynn W. Schultz, Campbellsport; Howard D. Hadler, West Bend; Terry Wendorff, Cedarburg, all of Wis.

[73] Assignee: Sno-way International, Inc., Hartford, Wis.

[21] Appl. No.: 08/747,142

[22] Filed: Oct. 31, 1996

Related U.S. Application Data

[60] Provisional application No. 60/006,185, Nov. 2, 1995, and provisional application No. 60/007,175, Nov. 1, 1995.

[51] Int. Cl.[6] ..... E01H 5/04

[52] U.S. Cl. ..... 37/271; 234/236

[58] Field of Search ..... 37/271, 231, 234, 37/235, 236, 239, 270, 268; 172/272, 273, 274, 799.5

[56] References Cited

U.S. PATENT DOCUMENTS

| | | | |
|---|---|---|---|
| 1,890,730 | 12/1932 | Hunt | 37/271 |
| 3,150,884 | 9/1964 | Drott | 37/231 X |
| 3,793,752 | 2/1974 | Snyder | 37/234 |
| 4,236,329 | 12/1980 | Hetrick | 37/231 |
| 4,259,794 | 4/1981 | Rath | 37/233 |
| 4,391,052 | 7/1983 | Guy, Jr. | 37/236 |
| 4,439,939 | 4/1984 | Blau | 37/231 |
| 4,807,375 | 2/1989 | Iraci | 37/236 |
| 4,821,435 | 4/1989 | Pester | 37/231 |
| 4,999,935 | 3/1991 | Simi et al. | 37/234 X |
| 5,050,322 | 9/1991 | Burkard | 37/270 |
| 5,125,174 | 6/1992 | Watson et al. | 37/231 |
| 5,136,795 | 8/1992 | Rosenberg | 37/231 X |
| 5,353,530 | 10/1994 | Pieper | 37/271 X |
| 5,361,519 | 11/1994 | Ciula et al. | 37/234 |
| 5,485,690 | 1/1996 | MacQueen | 37/235 X |

*Primary Examiner*—Tamara L. Graysay
*Assistant Examiner*—Thomas A. Beach
*Attorney, Agent, or Firm*—Reinhart, Boerner, Van Deuren, Norris & Rieselbach, s.c.

[57] ABSTRACT

A power assisted snowplow stand for allowing an operator of a snowplow the ability to position the snowplow to connect and disconnect the snowplow. The snowplow stand generally including a stand structure coupled to a power assist mechanism. The stand structure coupled to the snowplow. The invention also including a method for attaching a vehicle, including a subframe, to and operating power assisted snowplow stand for allowing an operator of a snowplow the ability to position the snowplow to connect and disconnect the snowplow; a stand structure coupled to the snowplow and a power assist mechanism being linked to a control system for controlling the power assisted snowplow stand. The stand structure including an up position and a down position. The method including positioning the vehicle subframe for engagement with the snowplow. Operating the control system to actuate the power assist mechanism to align the snowplow with the vehicle subframe. Engaging and coupling the vehicle subframe to the snowplow. Operating the control system to elevate the snowplow. Raising the stand structure to an up position.

13 Claims, 8 Drawing Sheets

WIRING SCHEMATIC
ROCKER SWITCH STYLE
(GRAVITY DOWN SYSTEM)

WIRING SCHEMATIC
ROCKER SWITCH STYLE
(DOWN PRESSURE SYSTEM)

POWER ASSISTED SNOWPLOW SUPPORT STAND

Benefit of earlier filing date of Provisional Patent Applications Ser. No. 60/006,185 filed Nov. 2, 1995 and Ser. No. 60/007,175 filed Nov. 1, 1995 is claimed.

BACKGROUND OF THE INVENTION

The present invention relates to the field of snowplows and specifically to stands for snowplows. Snowplows today are being made out of lighter and stronger materials than they have been made from in the past, however, they are still quite heavy pieces of equipment. In particular, detachable snowplows of the type that can be connected and disconnected to a vehicle present a particular problem in that they are somewhat difficult to connect and disconnect to and from a vehicle because of the weight associated with the plow. The connection or disconnection of the plow can be especially difficult if it is attempted by just one man or woman. Consequently, many types of connection and disconnection systems have been developed to reduce the amount of effort required by a person to connect or disconnect a snowplow to and from a vehicle. All these methods, while increasing the ease with which the snowplow may be connected to a vehicle or disconnected from a vehicle are still somewhat difficult because positioning the plow to be connected or disconnected many times requires dealing with the dead weight of the plow. Accordingly, the efficiency of connecting or disconnecting a plow may be greatly increased if an effective structure and/or method of dealing with the dead weight of the plow is applied.

The present invention by means of a unique and simple design effectively allows the operator of a plow to easily connect and disconnect his or her plow without being adversely affected by the dead weight of the plow itself. The inventors know of no prior art that teaches or discloses the present invention.

SUMMARY OF THE INVENTION

The invention is a power assisted snowplow stand comprising a stand pivotally connected to a frame of a snowplow. The stand is capable of being placed in either an up (stored) or down (in use position). The stand is mechanically coupled to a power assist mechanism. Preferably, but not necessarily the stand is mechanically connected to the power assist mechanism through a lever mechanism (a raise and lower direct linkage system. e.g., a bell crank or similar device).

The power assist mechanism may be one of many mechanisms including but not limited to an electrically controlled hydraulic cylinder system, an electrically controlled pneumatic cylinder system, or an electrically controlled jackscrew system. Additionally, the power assist mechanism may be a combination of either all or some parts of the hydraulic cylinder system, the pneumatic cylinder system, or the jackscrew system.

The power assisted snowplow stand is controlled through the power assist mechanism by a control mechanism. The control mechanism comprises, but is not limited to, a separate switch wired directly to the power assist mechanism or can comprise a wireless remote control system. Accordingly, the control mechanism will allow the stand to be controlled in a variety of ways including remotely from outside the vehicle or from within the vehicle.

The control system also is able to remotely actuate the pivoting mechanisms, typically hydraulic cylinders, available on some snowplows for pivoting the plow blade either to the left or to the right to allow an operator additional control in aligning the snowplow for attachment to a vehicle.

These and other benefits of the present invention will be apparent to one skilled in the art from the following description.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Further, it should be understood that the present invention, a power assisted stand for snowplows, is intended to be used with any snowplow system. However, for the sake of showing an environment in which the present invention may be used the features of the present invention are shown as they may be used in combination with a snowplow system as previously disclosed in U.S. Pat. application Ser. No. 08/225,215, filed on Apr. 8, 1994. The disclosure of which is incorporated by references into this patent application.

Figure 2:
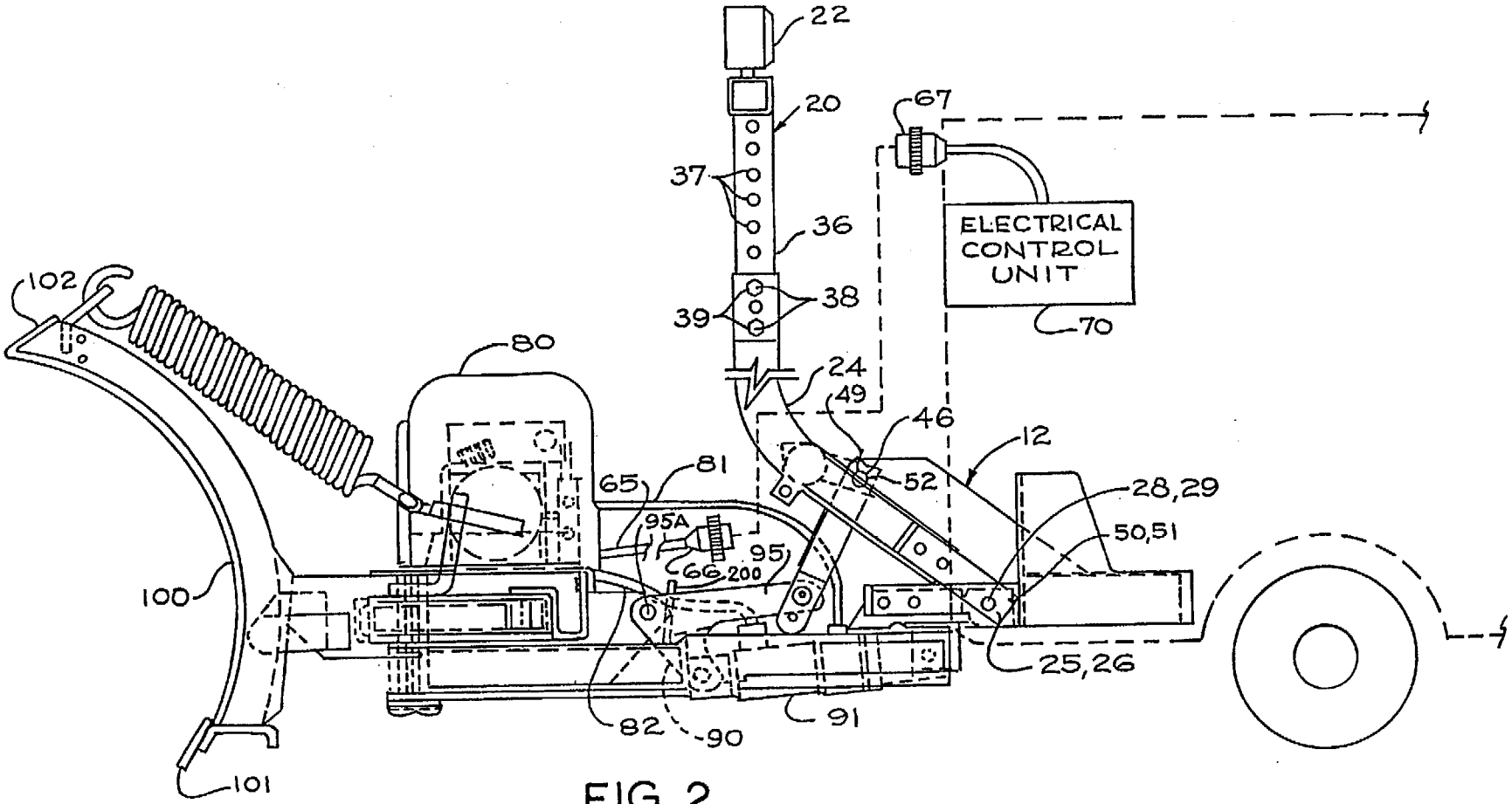
FIG. 2 is a side elevational view of a snowplow that may be connected to a vehicle generally showing the relationship of the present invention to the structure of the snowplow.
Figure 3:
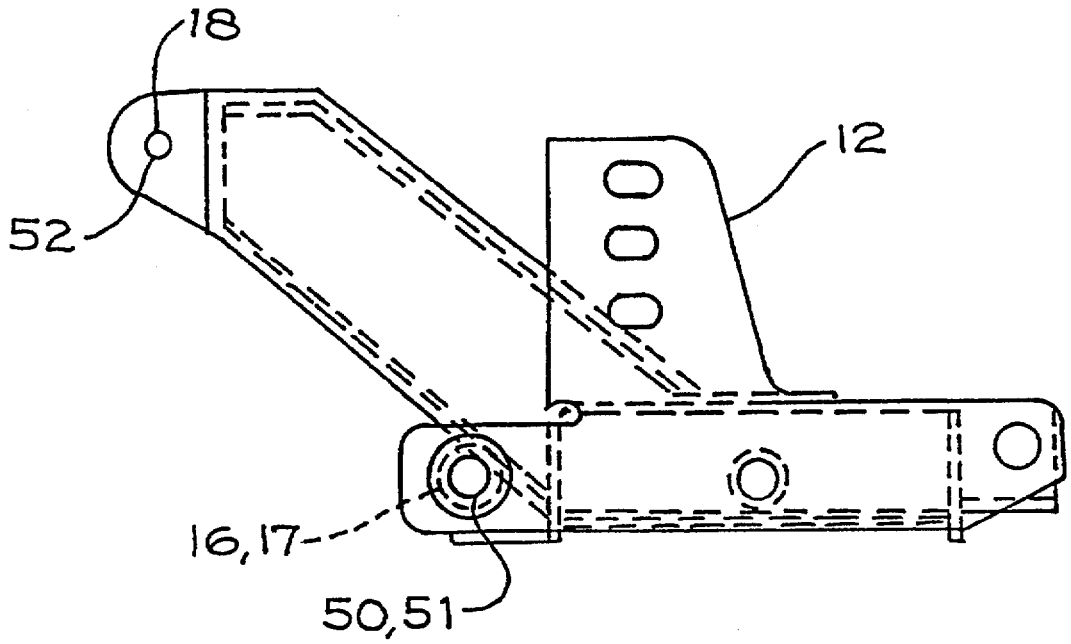
FIG. 3 is a side elevational view of a snowplow mounting bracket for connecting the snowplow to a vehicle.

Referring to the Figures, a snowplow system 10 for mounting to a vehicle 11 including a mounting system 40, a known hydraulic system 80 for supplying hydraulic fluid in predetermined amounts to the cylinders 12, 13, and 91, an electrical system 60 for controlling the valves and pumps affecting movement of the hydraulic fluid through the known hydraulic system, and a moldboard 100 and an A-frame 14 for supporting and connecting the components of the snowplow system 10 may be seen. The snowplow system 10 is connected to the frame of the vehicle 11 (shown in phantom in FIG. 2) with mounting system 40. Referring to FIGS. 2 and 3 the snowplow system 10 may be seen to be connected to a vehicle 11 by mounting subframe 12 that is fixedly connected to the frame of the vehicle 11. The present invention may be used with any vehicle to which a snowplow may be attached. It is not intended nor should any interpretation be made that the present invention of a power assisted snowplow stand be limited to use in combination with a particular type of vehicle.

Figure 1:
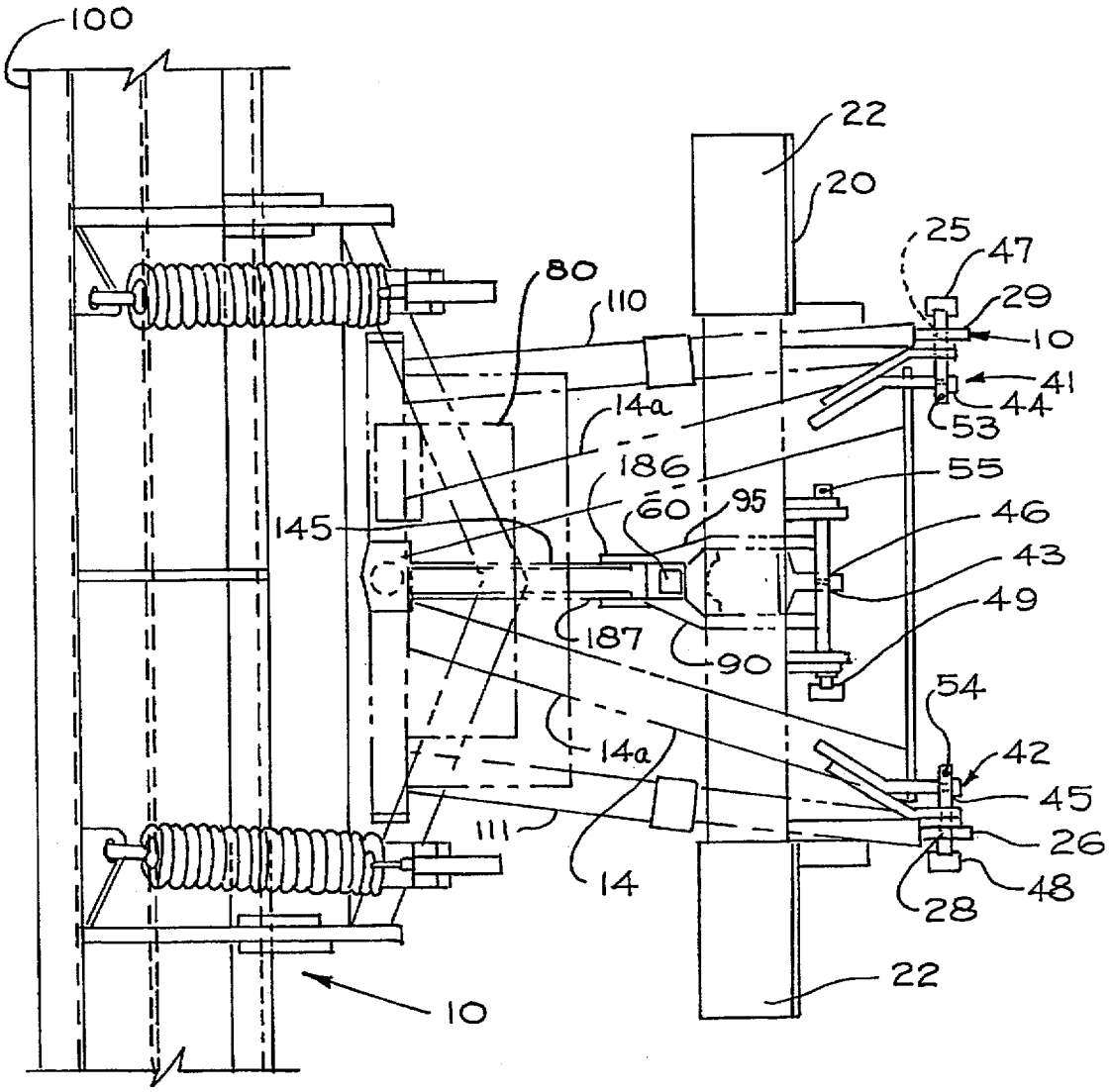
FIG. 1 is a top plan view of a snowplow that may be connected to a vehicle.

The mounting system 40 is integral to the A-frame 14 as shown in FIG. 1. The subframe 12 has mounting points 16–18 having openings 50–52 as shown in FIG. 3. The mounting system 40 has three mounting points 41–43, having openings 44–46, and three mounting pins 47–49. Mounting points 16–18 of the subframe 12 correspond to mounting points 41–43 of the mounting system 40 so that openings 50–52 align respectively with openings 44–46. Pins 47–49 pass through the aligned openings 50–52 and 44–46. Locking pins 53–55 are respectively used to hold the pins 47–49 in place in the openings 50–52 and 44–46 during operation of the vehicle 11. In this manner the snowplow system 10 is quickly and easily mounted to the vehicle 11 so that there is a rigid and fixed connection between the vehicle 11 and the snowplow system 10 through the mounting subframe 12 which is attached to the frame of the vehicle 11.

Figure 4:
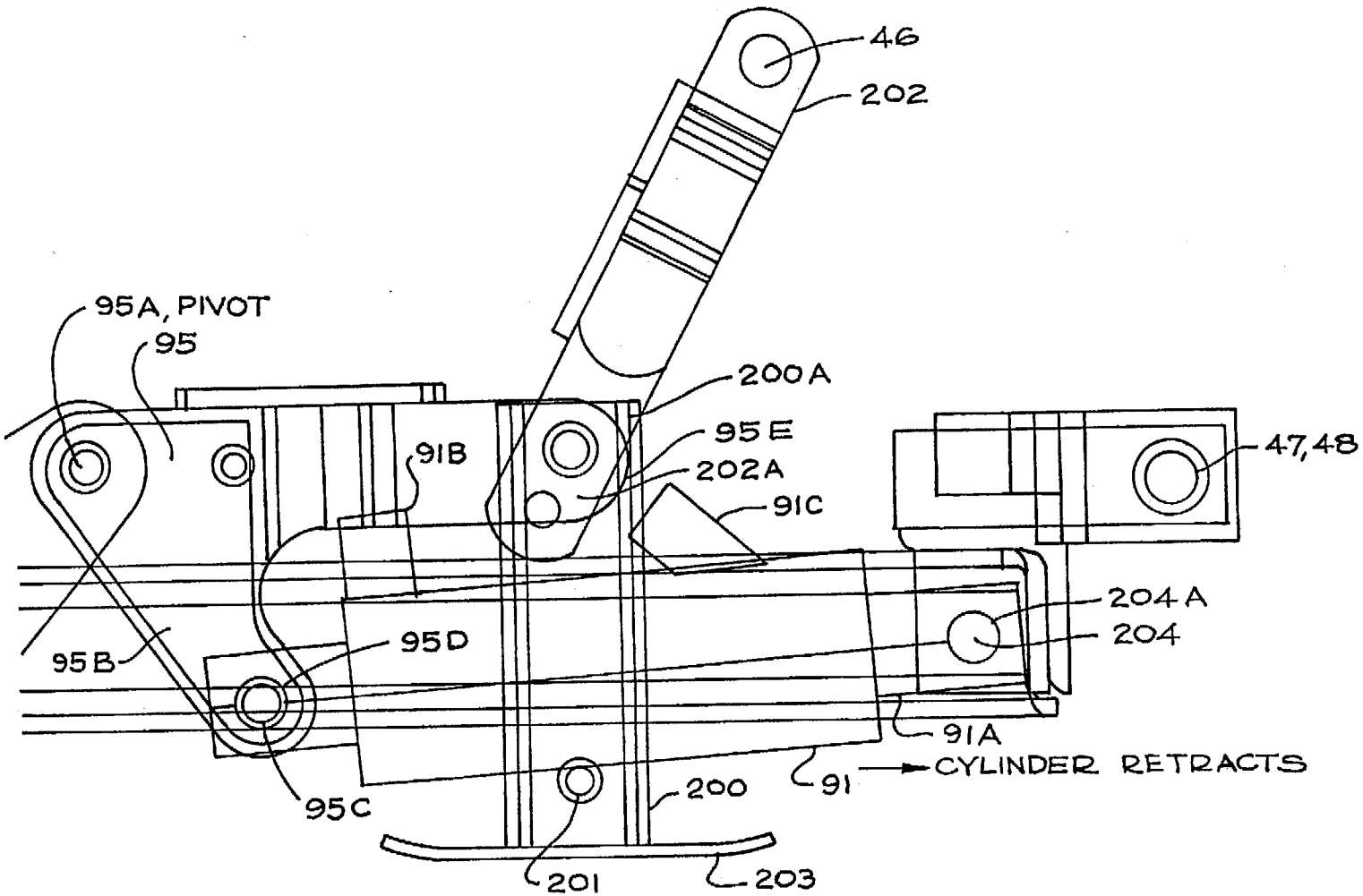
FIG. 4 is a side elevational view of the present invention showing the snowplow stand in the lowered position.
Figure 5:
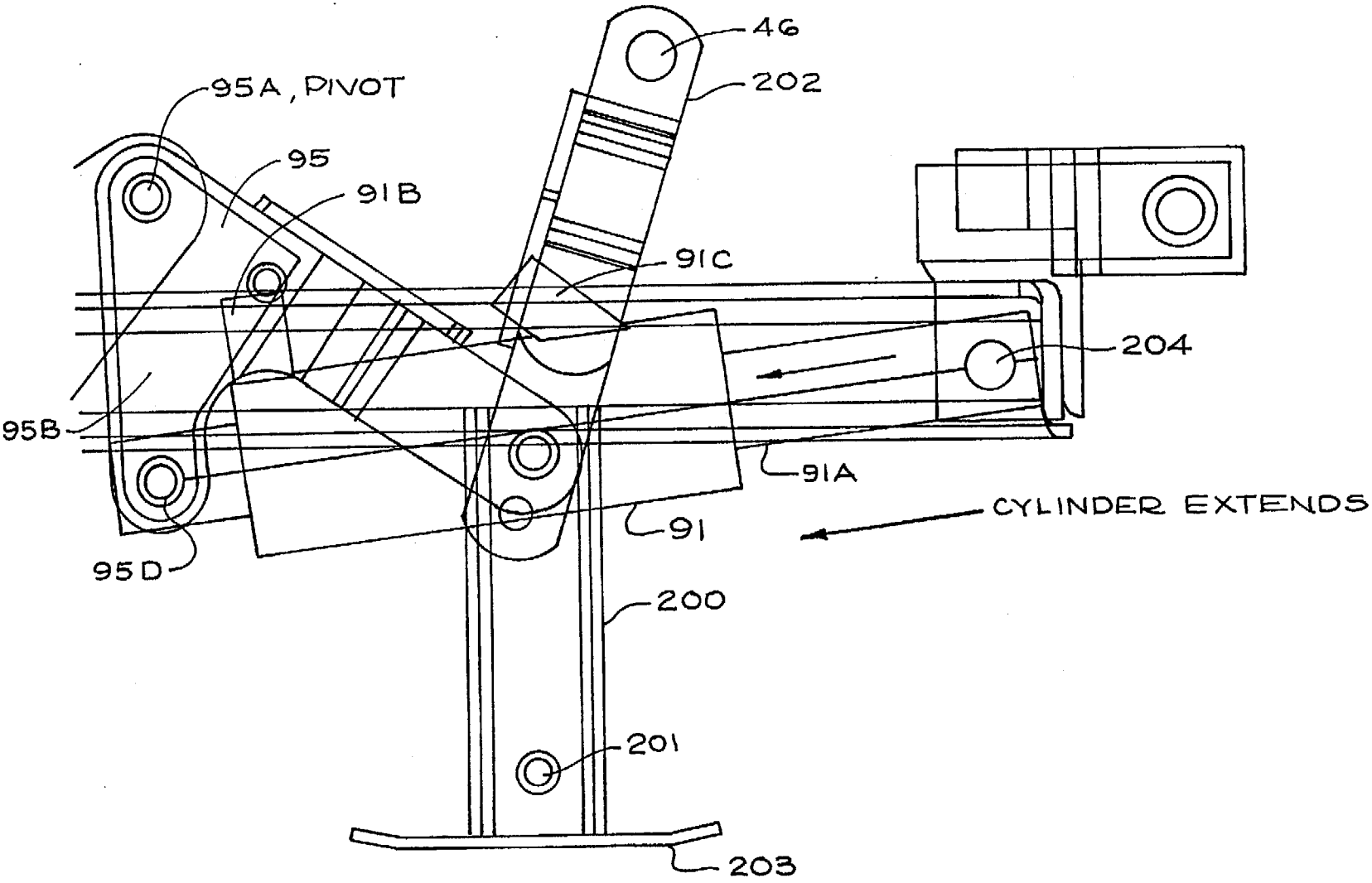
FIG. 5 is a side elevational view of the present invention showing the snowplow stand in the high or raised position.
Figure 6:
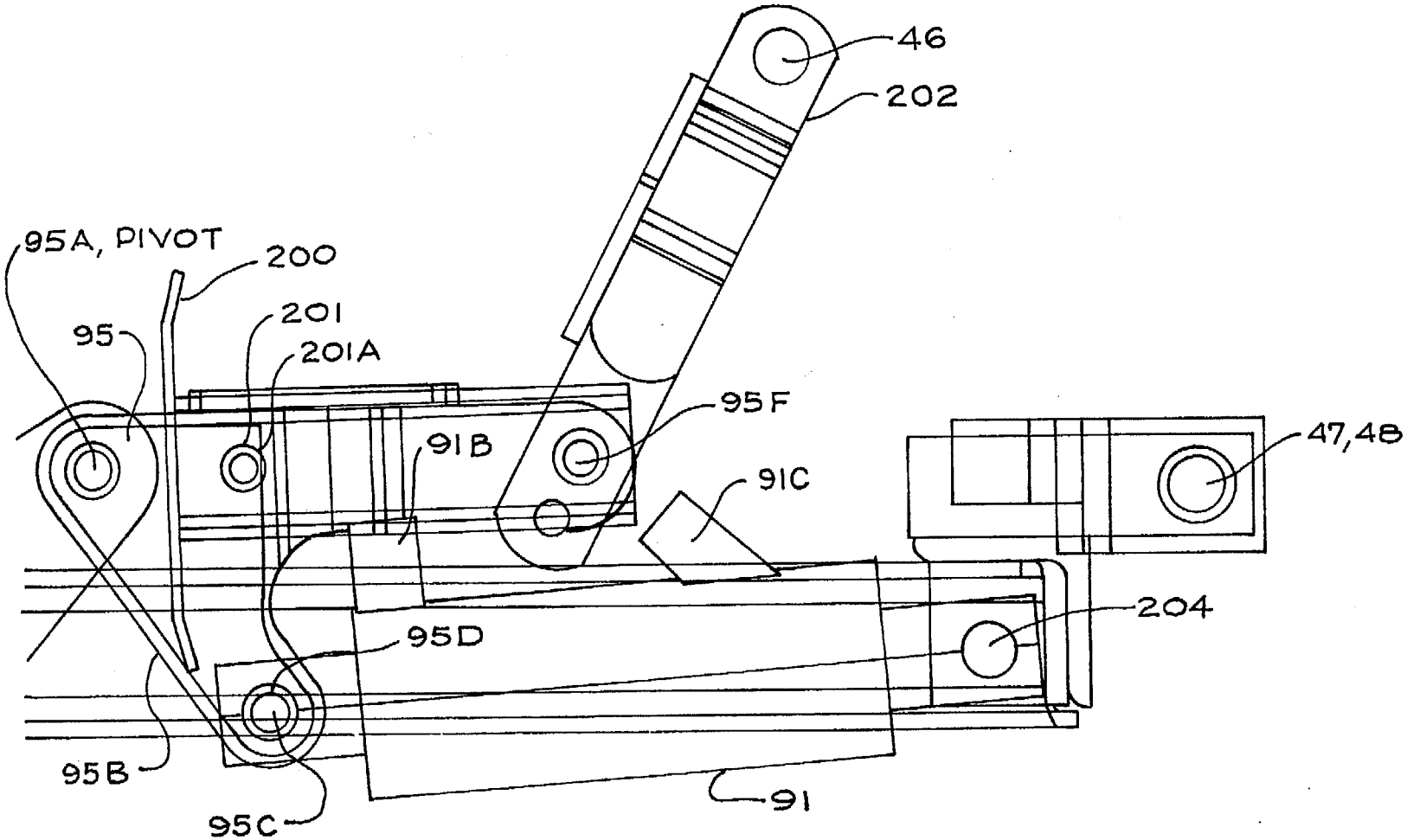
FIG. 6 is a side elevational view of the present invention showing the snowplow stand in the locked position.

Referring now to FIGS. 4–6 the power assisted snowplow stand 200 may be seen. The stand 200, in its preferred form, has related structures including a hydraulic cylinder 91, bell crank 95, lower bell crank pivot 95A, lower bell crank linkage 95B, shank end pivot 95C of hydraulic cylinder 91, connecting pin 95D, stand locking pin 201 (for locking the stand in place when it is in the up position), upper lift linkage 202, stand base 203, and piston end pivot 204. The hydraulic cylinder 91 is a double acting hydraulic cylinder and includes hydraulic fluid inputs 91B and 91C as well as piston rod 91A. The present invention operates when connected to the known hydraulic system 80 and the electrical system 60.

Referring to FIG. 4, the stand 200 may be seen in the lowered position. End 95E of bell crank 95 is pivotally connected to end 202A of upper lift linkage 202 and end 200A of stand 200. Hydraulic cylinder 91 is connected to lower bell crank linkage 95B at shank end pivot 95C by connecting pin 95D on one end and to rod end pivot 204 on A-frame 14 by pin 204A and its piston 91A. The snowplow is connected to the vehicle by the previously described connecting system.

Referring now to FIG. 5 the stand 200 may be seen to be in the high or raised position with the piston rod 91A of the cylinder 91 extended so that bell crank 95 is forced to move about lower bell crank pivot 95A. This causes the A-frame 14 of the plow to be raised and aids in the connection or disconnection of the plow to or from the vehicle 11.

Referring now to FIG. 6 the stand 200 may be seen in the locked transport position. The stand 200 is rotated back around pivot pin 95F so that spring loaded lock pin 201 may engage opening 201A.

Figure 7:
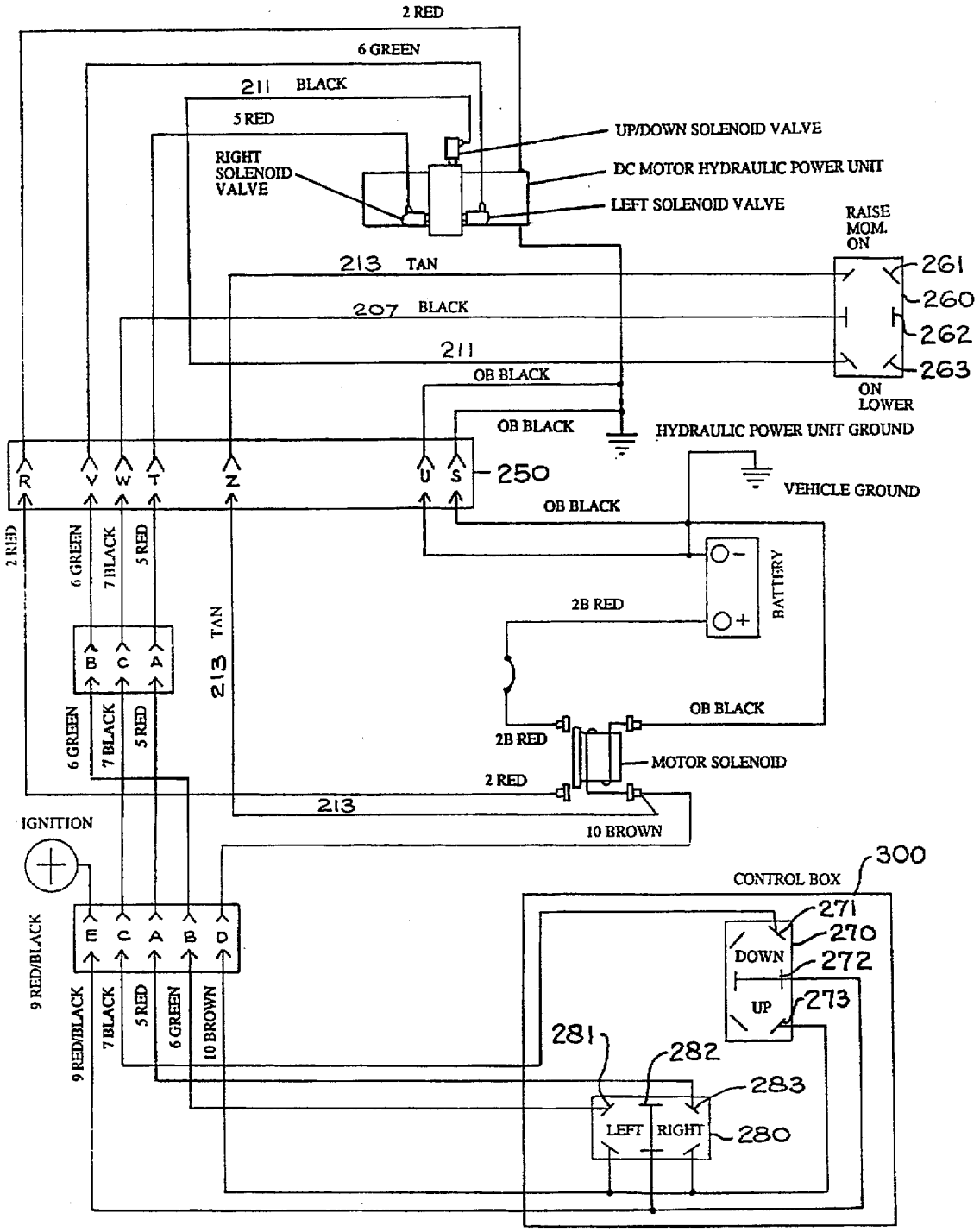
FIG. 7 is a schematic diagram showing the wiring diagram of the control system for using the present invention in conjunction with a snowplow having a gravity down system.

Referring now to FIG. 7, a wiring schematic for using the stand 200 with a plow having a standard gravity down or non-reactive system may be seen. The wiring schematic is intended to illustrate the function of the present invention in conjunction with the know hydraulic system 80. A tan wire 213 extends between the momentary on position of the remote site switch 260 and the motor solenoid, a black wire 207 is connected off the down coil, and a black wire 211 is connected to the down coil. The up/down switch 270 must be in the down position with the vehicle key on to operate the remote site switch 260. The remote site toggle switch 260 includes a momentary up position 261, a center position 262, and a down and lock on (lower) position 263. Ideally the remote site switch 260 is located on the plow structure itself so that it may be operated by an individual standing next to the plow mechanism.

Figure 8:
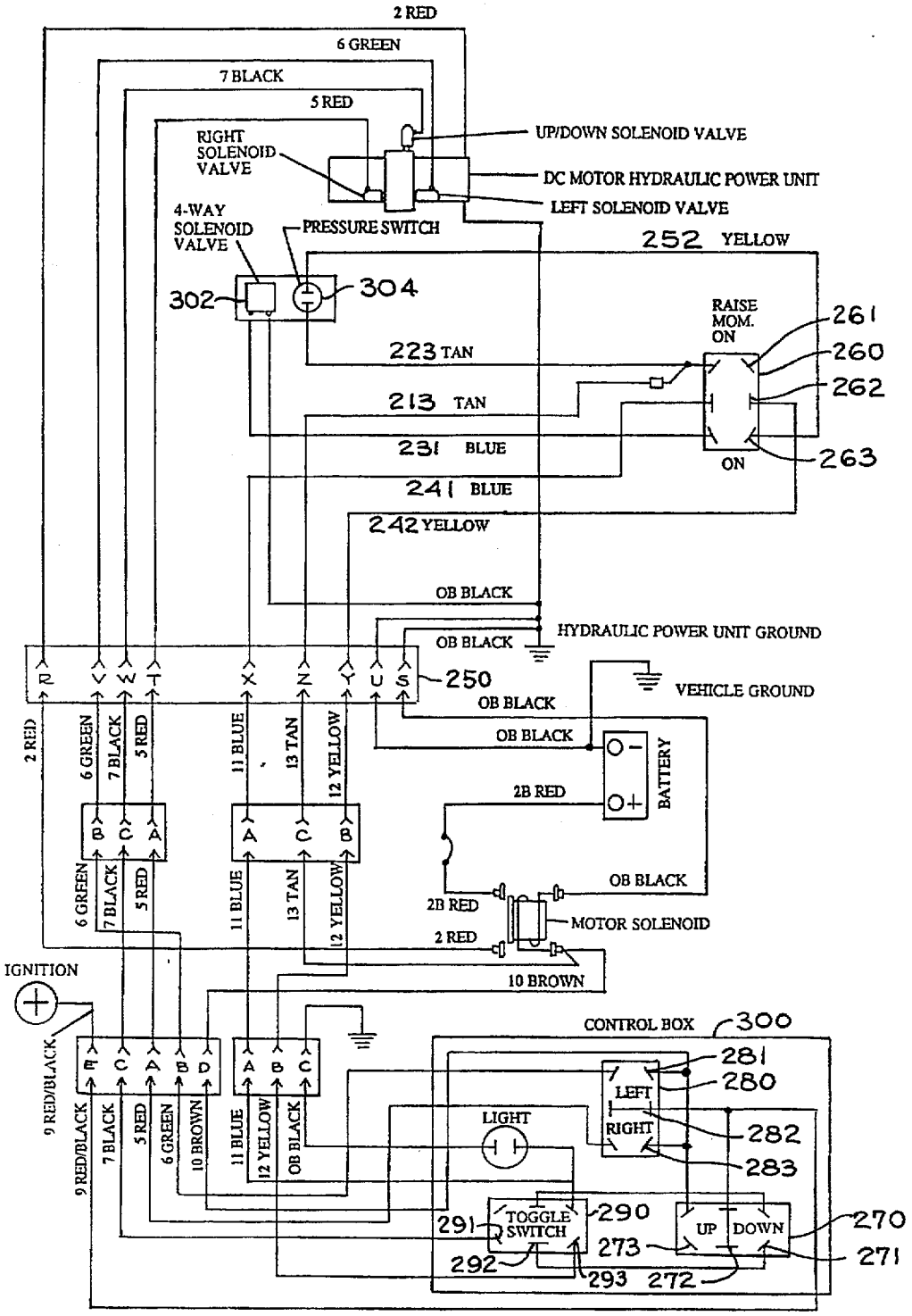
FIG. 8 is a schematic diagram showing the wiring diagram of the control system for using the present invention in conjunction with a snowplow having a down pressure plow system.

Referring now to FIG. 8 the wiring schematic for a plow using a down pressure system may be seen. The tan wire 213 is connected to the motor solenoid, the wire 241 extends from the control box 300, the blue wire 231 is connected to the 4-way solenoid valve 302, the yellow wire 252 is connected to the pressure switch 304, and the yellow wire 242 to the control box 300. The two center spades of the remote site switch 260 do not connect electrically. To operate the remote site switch 260 with the vehicle ignition key in the on position the up/down switch 270 in the vehicle 11 must be set to the down position 271 and the down pressure switch 290 must be set to down pressure (connecting to position 293).

Additionally, referring to FIGS. 7 and 8, it should be noted that, on a plow having a hydraulic system which includes hydraulic cylinders like cylinders 110 and 111 which are capable of adjusting the position of the moldboard 100 from left to right and vice versa, the plow stand 200, in its lowered position, may be used in conjunction with the left/right control switch 280 so that the plow linkage, when disconnected from the subframe 12 of the vehicle 11 may be moved left to right (or right to left) as well as up and down to properly align the mounting points 41–43 with the mounting points 16–18 of the subframe 12.

The present invention operates as follows: With the starting point being the snowplow attached to the vehicle 11 and on the ground the operation and use of the stand begins by placing the up/down switch 270 in the down position 271 and by activating the down pressure system switch inside the cab of the vehicle (by moving it to position 293). Please note that a snowplow having a down pressure system is not a requirement of the present invention and that operation of the power assisted snowplow stand 200 may be carried out on other types of snowplows, e.g. standard type snowplows having an electrical system as shown or equivalent to the ones shown in FIGS. 7.

Next, the remote stand switch 260 is moved from the lower/normal plow operation position 263 to the center or off position 262 (see FIGS. 7–8). This deactivates the snowplow from the down pressure system operation and places any stand functions in the off position.

Next, the spring loaded pin 201 is pulled out and the stand 200 is released from the transport position. This allows the stand 200 to rotate to a vertical position relative to the ground (see FIG. 4).

The next step is to pull the upper pin 49 releasing the snow plow upper lift link 202 from the subframe 12 which is attached to the vehicle 11. From this point the operator is able to raise and lower the snowplow for removal.

Next the two remaining pins 47 and 48 are move. The pins 47 and 48 secure the snowplow to the vehicle subframe 12. This is accomplished by first raising the snowplow enough to minimize the load on the two pins 47 and 48 to allow for easier removal of the pins. The operation to raise the snowplow occurs when the remote stand switch 260 is moved to the raised position. This in turn energizes the dc motor/hydraulic pump of the hydraulic system causing the hydraulic cylinder 91 to extend which in turn rotates the lower bell crank linkage 95B. This results in the stand 200 being lowered and the snowplow being raised. Deactivation of the raise function (position 261) occurs when the remote stand switch 260 is released. The switch 260 returns to the off position automatically because of this position being momentary. See FIGS. 7 and 8.

Next the two pins 47 and 48 are removed and the snowplow is then raised to its full height using the remote stand switch 260. This ensures total disengagement from the vehicle subframe 12.

Next the electrical connection between the snowplow and the vehicle 11 is disconnected. The vehicle 11 may then be backed away from the snowplow. This completes the disengagement process.

With the snowplow now detached from the vehicle 11, the operation and use of the stand 200 for attaching the snowplow to the vehicle 11 begins by moving the vehicle 11 within close proximity of the snowplow. The vehicle 11 must be close enough to allow the electrical connection to be made between the vehicle 11 and the snowplow.

Next, the operator must make sure that all functions of the snowplow controls inside the cab of the vehicle and the remote stand switch 200 are in the off position.

The next step is to make the electrical connection between the vehicle 11 and the snowplow. This is done by plugging the snowplow cable 65 and the vehicle cable 67 together.

After this is done the operator must place the up/down switch 270 in the down position and activate the down pressure system switch (to position 293) inside the cab of the vehicle 11. Then the snowplow must be raised to its maximum height. The operation to raise the snowplow is accomplished by moving the remote stand switch to the raise position 261.

After the snowplow has been raised to its maximum height the vehicle 11 must be aligned with the snowplow so that a proper connection may be accomplished. This alignment may be accomplished by driving the vehicle 11 into position or manually moving the snowplow into proper alignment with the attachment points 16–18 on the vehicle subframe 12.

When the vehicle 11 has been aligned the snowplow must be lowered to the point where it engages the subframe 12 of the vehicle 11. The operation to lower the snowplow occurs when the remote stand switch 260 is moved to the lower position 263. This in turn energizes the dc motor/hydraulic pump of the hydraulic system causing the hydraulic cylinder 91 to retract which in turn rotates the lower bell crank linkage 95B causing the stand 200 to raise and the snowplow to lower. Deactivation of the lower function occurs when the remote stand switch 260 is moved to the off position 262.

The next step is to move the snowplow using the raise function, or if necessary manually, on the remote stand switch 260. This is done to achieve proper alignment between the snowplow and the vehicle subframe 12. Once alignment is achieved the two lower pins 47 and 48 may be installed.

After the two lower pins 47 and 48 having been installed the remote stand switch 260 should be moved to lower/normal operation position 263. This will raise the stand 200 above the ground allowing the operator to rate the stand 200 and lock it into the transport position.

After locking the stand 200 into the transport position the remote stand switch 260 should be swung into the off position 262. After this is done the upper lift link 202 may be adjusted by hand into the proper alignment with the vehicle subframe 12 and the upper pin 49 is installed.

Finally, after the connection has been made the operator should move the remote stand switch 260 into the lower normal plow position 263. The operator can now use the snowplow.

The foregoing is considered as illustrative only of the principles of the invention. Furthermore, since numerous modifications and change will readily occur to those skilled in the art, it is not desired to limit the invention to the exact construction and operation shown and described.

What is claimed is:

1. A power assisted snowplow stand for allowing an operator of a snowplow to position the snowplow for connecting the snowplow to and disconnecting the snowplow from a vehicle, the snowplow stand comprising:

a stand structure coupled to the snowplow; and power assist means coupled to said stand structure for moving the snowplow substantially vertically relative to the vehicle to thereby adjust the position of attachment points of the snowplow relative to primary attachment points on the vehicle, said power assist means including a fluid pressure device, and a lever mechanism, wherein said stand structure is mechanically connected to said power assist means through the lever mechanism, said stand structure being pivoted to the lever mechanism to permit said stand structure to be moved to a travel position after the snowplow has been connected to the vehicle.

2. The power assisted snowplow stand of claim 1 wherein said stand structure is capable of being positioned in either an up position or a down position.

3. The power assisted snowplow stand of claim 1 wherein said lever mechanism is a bell crank.

4. The power assisted snowplow stand of claim 1 wherein said power assist means comprises an electrically controlled hydraulic cylinder system.

5. The power assisted snowplow stand of claim 1 wherein said power assist means comprises an electrically controlled pneumatic cylinder system.

6. The power assisted snowplow stand of claim 1 wherein said power assist means comprises the combination of at least one electrically controlled hydraulic cylinder mechanism and at least one electrically controlled pneumatic cylinder system.

7. The power assisted snowplow stand of claim 1 wherein said power assist means is linked to a control system mechanism.

8. The power assisted snowplow stand of claim 1, wherein said power assist means comprises a hydraulic cylinder having a shank end pivot, a connecting pin, an upper lift linkage, and a rod end pivot, and wherein said lever mechanism comprises a bell crank defining a lower bell crank pivot and a lower bell crank linkage; said bell crank having a first end connected to an end of said upper lift linkage and an end of said stand structure; said hydraulic cylinder being connected to said lower bell crank linkage at said shank end pivot by said connecting pin and to said rod end pivot by a pin structure.

9. A power assisted snowplow stand for allowing an operator of a snowplow to position the snowplow for connecting the snowplow to and disconnecting the snowplow from a vehicle; the snowplow stand comprising:

a stand structure coupled to the snowplow; and power assist means coupled to said stand structure for moving the snowplow substantially vertically relative to the vehicle to thereby adjust the position of attachment points of the snowplow relative to primary attachment points on the vehicle, said power assist means including a fluid pressure device, and a lever mechanism mechanically connecting said stand structure to said power assist means, said stand structure being pivoted to the lever mechanism to permit said stand structure to be moved to a travel position after the snowplow has been connected to the vehicle;

said power assist means being linked to a control system for controlling said power assisted snowplow stand.

10. The power assisted snowplow stand of claim 9 wherein the control system comprises a remote site switch, a motor solenoid, and an up/down switch; said remote site switch being electrically connected to said motor solenoid and said up/down switch; said remote site switch including a momentary up position, a center position, and a lower position.

11. The power assisted snowplow stand of claim 9 wherein the control system comprises a control box, a motor solenoid, a four way solenoid valve electrically connected to the control box, and a remote site switch; said remote site switch being electrically connected to said motor solenoid and said four way solenoid valve.

12. The power assisted snowplow stand of claim 11 wherein said control box includes an up/down switch and a down pressure switch; said up/down switch being electrically connected to said down pressure switch and said down pressure switch being electrically connected to said four way solenoid.

13. A power assisted snowplow stand to facilitate connecting a snowplow to and disconnecting the snowplow from a vehicle, the snowplow stand comprising:

a stand structure coupled to a frame of the snowplow, the stand structure including an elongated support member having a first end and second end, the support member being adapted to be pivoted about its first end relative to the snowplow frame between a travel position, in which the support member extends generally horizontally, and a use position, in which the support member extends generally vertically;

a power assist mechanism for controlling the stand structure for moving the snowplow substantially vertically relative to the vehicle to thereby adjust the position of attachment points of the snowplow relative to primary attachment points on the vehicle;

the power assist mechanism including a fluid pressure device and a lever mechanism including a bell crank for mechanically connecting the stand structure to the fluid pressure device, whereby the operation of the fluid pressure device, when the support member is in the use position, pivots the bell crank between a first position, in which the second end of the member is located at a first vertical position, and a second position, in which the second end of the support member is displaced downwardly from the first vertical position, thereby adjusting the vertical position of the attachment points of the snowplow relative to the attachment points on the vehicle to facilitate the attachment or removal of the snowplow from the vehicle.

* * * * *